US009764893B1

(12) United States Patent
Westmoreland, III

(10) Patent No.: US 9,764,893 B1
(45) Date of Patent: Sep. 19, 2017

(54) THIEF HATCH MONITORING SYSTEM

(71) Applicant: Aubrey Dare Westmoreland, III, Marshall, TX (US)

(72) Inventor: Aubrey Dare Westmoreland, III, Marshall, TX (US)

( * ) Notice: Subject to any disclaimer, the term of this patent is extended or adjusted under 35 U.S.C. 154(b) by 0 days.

(21) Appl. No.: 15/283,835

(22) Filed: Oct. 3, 2016

(51) Int. Cl.

| | |
|---|---|
| ***B65D 90/22*** | (2006.01) |
| ***B65D 90/10*** | (2006.01) |
| ***B65D 90/48*** | (2006.01) |
| ***G08B 21/18*** | (2006.01) |
| ***G08B 21/12*** | (2006.01) |

(52) U.S. Cl.
CPC ..... *B65D 90/22* (2013.01); *B65D 90/10* (2013.01); *B65D 90/48* (2013.01); *G08B 21/12* (2013.01); *G08B 21/18* (2013.01)

(58) Field of Classification Search
CPC ..... B65D 90/22; B65D 90/10; B65D 90/48; G08B 21/12; G08B 21/18
USPC ..... 340/686.1
See application file for complete search history.

(56) References Cited

U.S. PATENT DOCUMENTS

2002/0190068 A1* 12/2002 Sisk ..... B65D 90/10 220/263
2010/0200307 A1* 8/2010 Toms ..... G01G 19/042 177/163
2013/0264341 A1* 10/2013 Cockerham ..... B65D 90/105 220/203.29
2014/0116402 A1* 5/2014 Horiba ..... F02M 25/0836 123/520
2015/0040517 A1* 2/2015 Furuse ..... B65B 51/146 53/405
2015/0362394 A1* 12/2015 Shimoyama ..... G01L 9/0001 73/702
2016/0001935 A1* 1/2016 Smith ..... B65D 90/10 29/428
2016/0288994 A1* 10/2016 Lorenzen ..... B65D 90/48
2017/0138498 A1* 5/2017 Kayser ..... F16K 27/0209

FOREIGN PATENT DOCUMENTS

DE 102011056835 A1 * 6/2013 ..... F16J 15/064

* cited by examiner

*Primary Examiner* — Hirdepal Singh

(57) ABSTRACT

The present invention is directed to a device and system for monitoring the closure state of a hatch. A pressure sensor is positioned between the upper sealing ring of the hatch lid and the lower sealing ring of the flange, adjacent to or within the pressure gasket. In the open position, force sensor detects little force between the upper and lower sealing rings, in the closed position, the sensors detects an increase in force, but in the closed and latched position, the force sensor detects much higher force between the upper and lower sealing rings. The force sensor is electrically coupled to a monitor unit that communicates the force readings (either as raw or processed data) to remote locations such as data/processing remote centers, clouds, or portable devices. Cry-out alarms may be employed to alert operators when a hatch is open or not securely latched.

18 Claims, 16 Drawing Sheets

PRIOR ART

PRIOR ART

PRIOR ART

PRIOR ART

PRIOR ART

PRIOR ART

THIEF HATCH MONITORING SYSTEM

BACKGROUND OF THE INVENTION

The present invention is related to storage tanks and system used for containing liquids having volatile organic compounds.

More particularly, the present invention is related to access hatches for inspecting and sampling the liquids contained within a storage tank.

A storage tank (referred to alternatively throughout as a tank, stock tank or storage tank) for containing liquids may be of any type, terrestrial, marine, rail or truck and constructed of virtually any industrial material, steel, fiberglass and plastic being the most common. Storage tanks intended for containing liquid hydrocarbons (oil, crude oil, refined products, drip gas, etc.) that may produce volatile organic compounds (VOCs) are typically constructed of steel or fiberglass.

Most tanks exhibit generic design features, such as that depicted in FIG. 1. These include the tank exterior shell 101 having continuous sides, floor and roof (some designs employ floating external or internal roofs) for containing liquid 110 in its interior, while preventing harmful VOCs 114 from being vented into the atmosphere. Liquids 110 are piped into the interior of tank 100 through inlet pipe 106 and drained from tank 100 through outlet pipe 108. Liquid 110, most often a hydrocarbon based fluid, such as crude oil and refined products, emit VOCs 114 into the tank volume above the surface 112. One or more VOC recovery systems 105 recovery VOCs 114 as they are emitted from fluid 110. VOCs 114 exit tank 100 from a pipe opening in the roof (which may be stationary, floating or have both) and into a closed conduit connected to a recovery apparatus of some type. Additionally, emergency vent 104 is provided on the roof for venting VOCs 114 into the VOC recovery system (or the atmosphere as shown) for the case of a rapid buildup of pressure within the interior tank 100 not handled by VOC recovery system 105. Finally, disposed on the roof of tank 100 is a manhole or access hatch, enabling tank operators to gain access to liquid 110. Generically, these hatches are known in the petroleum industry as "thief hatches" because they enable tank operators to visually inspect and gauge the contents of tank 100, as well as "thief" or sample the liquid stored within.

The EPA has identified the thief hatch misuse as a major contributor for the unchecked release of VOCs into the atmosphere. In fact, several state environmental agencies have dubbed thief hatches as the weakest link of VOC control and mandated specific thief hatch monitoring and management. Misuse occurs in a number of ways. First, obviously, by tank operators leaving the thief hatch open following thiefing operations. Second, and much less conspicuous, is by leaving the thief hatch closed, but unlatched. Generally, unless "dead weighted", thief hatches are relatively light weight and will not substantially reduce the flow of VOCs into the atmosphere unless the lid is securely latched to its base.

Another form of hatch misuse is related to thief hatch maintenance. Poor maintenance practices and standards are a major contributing factor to VOC leakage. While leaks can occur due to sealing ring wear or failure on the base flange and/or hatch cover, vacuum plate damage, pressure or vacuum compensation spring failure or valve stem or guide wear, by far the most common maintenance related failure involves the pressure or cover gasket (described hereinafter as a pressure gasket, lid cover gasket of merely a cover gasket). The atmospheric seal for a thief hatch for use in the petrochemical industry is provided by a pliable or semi-pliable cover gasket or seal. Typically, cover gaskets for thief hatches are comprised of neoprene, Nitrile, BUNA-N (nitrile) rubber, EPDM rubber (ethylene propylene diene monomer (M-class) rubber), ECH (Epichlorohydrin) or Viton® (Viton® is a registered trademark and tradename of E.I. DuPont de Nemours and Company, Inc. of Wilmington, Del.). However, other materials may be used as gasket materials depending on the demands of the respective usage, these include, but are not limited to open and closed cell foam and sponge, natural rubber, BUNA-N (nitrile) rubber, BUNA-S rubber, ECH (epichlorohydrin), neoprene rubber, neoprene coated fabrics, EPDM rubber, EPDM sponge, silicone rubber, EVA (ethylene vinyl acetate), polyethylene, polystyrene, polypropylene, polyurethane, polyimide, PVC sponge, vinyl—flexible & rigid, bucote, nicote, steel, stainless steel, cork, cork-rubber compositions, plastics, cloth, cloth inserted rubber and coated fabrics. Due to the design of most thief hatches, the gasket material must have a very low hardness. The quantification of gasket hardness, durometer, is an exceptionally complicated subject and will not be discussed herein, except to mention that the hardness of elastomeric gasket materials is usually described by two parameters: Shore hardness and compression force deflection (CFD). Shore hardness in this context (Shore A) is a measure of how well a material resists a permanent indentation. CFD is a measure of firmness as defined by ASTM standard D1056, as the force necessary to reduce the thickness of a material by 25%). Both Shore A and CFD for thief hatch gasket materials must be low in order to provide a tight seal with relatively low closure force provided by the pressure compensation spring in the pressure/vacuum compensation valve (the design and function of the pressure/vacuum compensation valve system will be discussed below with regard to FIGS. 2 and 3).

In any case, good thief hatch maintenance requires the thief hatch gasket be in good physical repair and the gasket and corresponding upper and lower sealing rings be free of any contaminants that may inhibit proper sealing. Thief hatch maintenance is difficult to qualify because often the appearance of the gasket and corresponding upper and lower sealing rings is not noteworthy. However, repeated thiefing and gauging operations contribute to the degradation of the gasket and sealing rings. Typically, only a single field gauger climbs onto the tank's roof with a plumb bob, line, sampling thief, thermometer, sample containers, notepad and other tools as needed. The gauger opens that lid of thief hatch 102, drops the plumb bob and checks, verifies and records the fluid level. Next, temperatures are recorded from various depths. Finally, the gauger thiefs samples of fluid from various depth and transfers the samples to corresponding sample containers and records the samples' information. All too often the gauger retrieves the final thief sample, slams the thief hatch lid and latches it with his foot while simultaneously transferring the fluid sample from the thief to the container. Field gaugers travel from one tank to another, pad to pad, and site to site in a rather hectic fashion, gauging/thiefing different tanks at different schedules. Consequently, thief hatch gaskets become worn, torn or deformed from repeated hard lid closings and from contaminates that accumulate on the thief hatch gasket and corresponding lower and upper sealing rings from spillage from line, gauging and thiefing operations, as well as from merely opening and closing the hatch cover as will be discussed below. All of the above contribute to VOC leakage at the pressure gasket.

Improper thief hatch operating has become such an issue that several states now require that only trained field gaugers open thief hatches and that they follow a strict protocol of: verify absence of VOCs; unlatch the thief hatch lid; inspecting lid, valve, gasket and upper and lower sealing rings; perform gauging/thiefing operations; re-inspect lid, valve, gasket and upper and lower sealing rings; cleaning lid, valve, gasket and upper and lower sealing rings; replace thief hatch and valve gaskets as needed; close lid; latch thief hatch lid, verify full engagement of the thief hatch latch and verify absence of VOCs.

FIGS. 2A, 2B, 2C and 2D are oblique, side, top and cross-sectional views of a diagram for a generic thief hatch. Typically, thief hatches 102 comprise four basic components: lid 202 and hatch cover 230 assembly (including upper sealing ring 232 and pressure/vacuum compensation valve mechanism 234), flange base 220 and lower sealing ring 224 assembly, hinge 208 assembly with optional latch 204 with catch 206. Disposed along flange base 220 of thief hatch 102 is a plurality of bolt holes for receiving bolts or studs 226 from the roof of tank 100 over flange gasket 222 (threaded nuts are used in conjunction with studs). Lid 202 and hatch cover casting 230 are two independent assemblies joined together with the pressure/vacuum compensation valve 234, the function of which will be described further below. Lid 202 and hatch cover casting 230 pivot horizontally from flange base 220 via hinge 208 about hinge pin 209 (as can be seen in FIG. 3A). In practice, one leaf of hinge 208 is secured to lid 202, as is catch 206, while the second leaf is secured to flange base 220 and the leaves are hingedly coupled with hinge pin 209.

Generally, in the closed position, lid 202 completely covers flange base 220. Also, upper sealing ring 232 of hatch cover 230 engages lower sealing ring 224 of flange base 220, with lid pressure gasket 210 interposed between the two to provide an air-tight seal. Lid pressure gasket 210 is positioned adjacent to upper sealing ring 232 on hatch cover casting 230 and secured by friction to vertical lip 233 of hatch cover casting 230. Pressure gasket 210 is most often a circular shaped flat seal comprised of a pliable or semi-pliable material as described above. Optionally, lid pressure gasket 210 may have a "U"-shape cross-sectional shape that fits snuggly over the outer edge of upper sealing ring 232 of hatch cover casting 230 (not shown in the figures). While in the closed position, optional latch 204 pivots about latch pin 205 and onto catch 206, thereby latching lid 202 to base flange 220.

In the latched position, latch 204 secures lid 202 to base flange 220 through catch 206 at a force predetermined by pressure compensation spring 235 within pressure/vacuum compensation valve 234, discussed immediately below. Maintaining a constant uniform pressure on lid pressure gasket 210 from hatch cover casting 230 toward lower sealing ring 224 on flange base 220 is key to sealing VOCs within tank 100. Here it should be mentioned that not all thief hatch designs utilize a latching mechanism, some use dead weight of lid 202 for exerting sealing force (pressure) (not shown in the figures). In addition, latch 204 and catch 206 assembly depicted in the figures are merely one exemplary latch, other latch designs employ a "J"-hook, and/or J-hook and cam mechanism or various types of levered cams for amplifying a force between hatch cover casting 230 and flange base 220 (also not shown in the figures).

The force (pressure) exerted on lid pressure gasket 210 from hatch cover casting 230 is predetermined by pressure compensation spring 235 inside pressure/vacuum compensation valve 234. Hatch cover 230 is movably secured to lid 202 through pressure/vacuum compensation valve 234. Pressure/vacuum compensation valve 234 is a means for compensating the internal pressure of tank 100 to near that of the atmosphere to avoid rupturing or imploding the tank's exterior shell 101 i.e., the tank's walls and roof). Pressure/vacuum compensation valve 234 is cylindrically-shaped and generally comprises a pair of springs which enable each of lid 202 and vacuum plate 239 to move (open) independently of one another in order to compensate for pressure differences between the interior of tank 100 and the atmosphere.

Pressure compensating spring 235, disposed within pressure/vacuum compensation valve 234, forces lid 202 and hatch cover casting 230 apart. In closing lid 202 onto base flange 220, pressure compensating spring 235 is compressed. This exerts a predetermined downward force on lid 202, thereby squeezing lid pressure gasket 210 between the upper surface of lower sealing ring 224 on flange base 220 and the lower surface of upper sealing ring 232 on hatch cover casting 230. Consequently, the magnitude of the sealing force across pressure gasket 210 is determined by the compressive strength of pressure compensating spring 235. In the case of internal pressure within tank 100 increasing, the pressure creates an upward force on the lower surface of hatch cover casting 230 (and vacuum compensation plate 239). Once that upward force exceeds the sealing force created by pressure compensating spring 235, hatch cover casting 230 moves upward relative to lid 202, thereby breaking the seal of pressure gasket 210 and allowing vapors from tank 100 to escape into the atmosphere through lid cover opening 212. Dead weight thief hatches do not use pressure compensating valves for controlling the interior pressure of tank 100, but instead use the dead weight of the lid to provide a predetermined level of sealing force.

Vacuum compensating spring 236 is a compression spring disposed within pressure/vacuum compensation valve 234 and forces vacuum plate 239 and hatch cover casting 230 together. The magnitude of the force is predetermined by the compressive force of vacuum compensating spring 236. In case of a vacuum occurring within tank 100, the atmospheric pressure is greater than the internal pressure of the tank. When the force on the upper surface of vacuum plate 239 (created by the atmospheric pressure reaching vacuum plate 239 through vacuum compensation ports 237 and lid cover opening 212) exceeds the combined force of vacuum compensating spring 236 and the force on the lower surface of forces vacuum plate 239 created by the internal pressure of tank 100, vacuum plate 239 moves downward relative to lid 202, thereby breaking the seal of vacuum plate seal 240 and air from the atmosphere to enter tank 100 through vacuum compensation ports 237 and from lid cover opening 212. Some dead weight thief designs make use of a vacuum compensating valve to compensate for vacuum conditions within tank 100.

With further regard to latching thief hatches with regard to VOC leakage, such as those exemplary hatches depicted in the figures, these hatches may be understood to operate in three distinct positional or closure states. FIGS. 3A, 3B, and 3C are diagrams depicting the three closure states of a typical thief hatch: open in FIG. 3A; closed in FIG. 3B and closed and latched in FIG. 3C. One could conclude from the figures that thief hatch 102 of FIG. 3B in the closed position and of FIG. 3C in the closed and latched position are remarkably similar. However, with some hatch designs (and depending on the compressive strength of pressure compensating spring 235) lid 202 will be slightly skewed from flange base 220, as is apparent from the position of lid 202 in FIG. 3B. This is often very slight and virtually impossible to recognize from any vantage point except a direct side view. However, as a practical matter, in the closed (but not latched position) these hatches are actually open and not sealed. Only a small portion of pressure gasket 210 is actually in contact with lower sealing ring 224 of base flange 220, leaving the remaining circumference of pressure gasket 210 unsealed and open to the atmosphere.

FIGS. 3D and 3E are cross sectional views of thief hatch 102 with lid 202 closing (or opening) onto base flange 220 which better depicts the movement of pressure/vacuum compensation valve 234 during opening and closing of lid 202. By design, the lowermost portion of pressure/vacuum compensation valve 234, including vacuum plate 239, extends beyond the lower edge of lid 202 whenever lid 202 is closed as can be seen in FIG. 2D, where thief hatch 202 is depicted in the closed position. However, in the open position, upper sealing ring 232, lid pressure gasket 210 and vertical lip 233 of hatch cover 230 all extend beyond the lower edge of lid 202 as can be understood by comparing thief hatch 202 depicted in FIG. 2D, in the closed position, with thief hatch 202 depicted in FIG. 3A, with thief hatch 202 in the open position.

More importantly for understanding the need for the present invention, as lid 202 closes about hinge 208, initially lid pressure gasket 210 contacts lower sealing ring 224 of base flange 220 only at a point nearest to hinge 208, see FIG. 3D. At that position, pressure compensation spring 235 is fully extended. As lid 202 continues to close about hinge 208, lid pressure gasket 210 continues its bias against lower sealing ring 224, which gradually compresses pressure compensation spring 235 (compare pressure compensation spring 235 in FIG. 3D with that in FIG. 3E). Importantly, the lower surface of lid pressure gasket 210 scrapes along the upper surface of lower sealing ring 224 while exerting closing force to pressure/vacuum compensation valve 234 until pressure/vacuum compensation valve 234 is in its uppermost position see FIG. 2D and lid 202 is fully closed. This closing process takes a toll on lid pressure gasket 210. To be sure, the above-described phenomenon is not uncommon occurrence with hatches or other types of doors with seals, such as home entry doors. In certain critical applications, such as pressurized aircraft fuselage doors, the hatch uses an interlocking hinge system that first allows the hatch to swing into the closing position without the door seal contacting the frame, and then the hinges, hatch and door seal move parallel to and mates with the frame in unison, thereby eliminating friction on the door seal.

However, with regard to the thief hatch applications, stress on the portion of lid pressure gasket 210 closest to hinge 208 is even more pronounced because that part of lid pressure gasket 210 is the support member that absorbs all of the biasing force necessary to compress pressure compensation spring 235 through the range of closing angles, compare lid 202 in FIGS. 3A, 3D, 3E, and 2D. The closing/opening forces have even a more dramatic wear effect on gasket 210 due to the low durometer of the gaskets used in thief valves. Additionally, as is apparent from the figures, the moving components of pressure/vacuum compensation valve 234 are subject to accelerated wear because the closing force is not applied parallel to the movement direction of hatch cover 230. Consequently, aside from the inherent problems associated with closing and latching a thief hatch, VOC leakage from mechanical failure is also very prevalent.

Although VOC leakage from mechanical failures happens, the far more pervasive, as well as correctable problems, are hatch closure issues. Clearly, operators can easily mistake a closed thief hatch for a closed and latched thief hatch (as demonstrated by the views in the previous figures). It is often even more difficult to distinguish merely closed from closed and latched with other latch designs, such as those where the latch extends downward from the thief hatch lid, because pressure gasket 201 is not fully in place with lid 202 merely closed. For those designs, the latch automatically falls into a nearly latched position by closing the hatch, often an operator must wiggle the latch to determine whether or not it is actually engaged with the latch catch. Very importantly, however, a closed but not latched thief hatch can leak VOCs at substantially at same rate as that of a thief hatch in the open position. Hence, even though a closed thief hatch appears similar to a closed and latched thief hatch, for the purposes of VOC abatement, a closed thief hatch is actually much more similar in operation to an open thief hatch. Consequently, recent efforts have been made to verify that a thief hatch is actually truly latched and not merely closed.

The prior art has dealt with the problem of securing thief hatches by employing various sensors to detect the position of the thief hatch lid. The detector is often connected to a light or audible alarm for alerting operators when the thief hatch lid is open. For example, an adjustable, normally closed (momentary off) door plunger switch 402, as depicted in FIG. 4A closes the alarm circuit when the thief hatch lid is open. Plunger switch 402 comprised mounting hardware (not shown), body 404 containing the switch contacts and spring, plunger 408 and plunger adjustment 406 for adjusting the vertical height of plunger 408 in the electrically open state. Typically, plunger switch 402 mounts to flange base 220 directly below an edge of thief lid 202 and height of plunger 408 is adjusted to the electrically open state with thief hatch lid 202 fully closed as depicted in FIG. 4B, but electrically open state with thief hatch lid 202 in any state except fully closed, see, for example, FIG. 4C.

Adjusting the correct operating height of plunger 408 is critical to its proper operation. Additionally, for maximum effectiveness, plunger switch 402 must be located opposite the hatch hinges, near latch 204. In this position, plunger switch 402 is highly suitable to being jolted and bumped during gauging and thiefing operations. In any case, while this prior art mechanism will alert the operator to an open thief hatch, it generally cannot distinguish between a thief hatch that is merely closed, from one that is completely latched.

What was needed was a sensor that detects the position of thief hatch latch 204, not merely the position of thief hatch lid 202. One mechanism for sensing the proper latch position known in the prior art is, for example, a normally open reed switch 502, as depicted in FIG. 5A. Reed switch 502 comprised mounting hardware (not shown), body 504 containing reed switch contacts (also not shown) with a ferric arm attached to one reed contact and magnet 506. Whenever the ferric arm inside body 504 is proximate to magnet 506, the magnet attracts the ferric arm, causing the attached reed contact to close on a second internal contact, thus completing an electrical circuit. Typically, reed switch body 504 is mounted to flange base 220 in a position proximate to the position of thief hatch latch 204 when fully engaged with latch catch 206, see FIGS. 5B and 5C. Magnet 506 is then attached to thief hatch latch 204 at a position closest to body 504 with thief hatch latch 204 fully engaged with latch catch 206. Here, rather than the switch circuit closing with the position of thief hatch lid 202, the reed contacts close the alarm circuit whenever magnet 506 attached to thief hatch latch 204 is proximate to body 504, that is whenever thief hatch latch 204 engages latch catch 206.

Other reed switch sensors for "J" latch designs use a pair of pins, one for catching and the other as a hinge pin for the J hook. With those, the pins are modified, the catch with an internal magnet and the hinge pin for the J hook is supplied with a reed switch as the one described above. This type "J" latch is easily modified for a lid position sensor by merely replacing the original catch and J hook hinge pin with the modified components.

This type of sensor overcomes the shortcoming of the prior art sensor's inability to distinguish between a closed thief hatch and a closed and latched thief hatch. However, reed switch 502 only senses the position of thief hatch latch 204. It is possible for the latch's position to mimic the fully engaged position without thief hatch lid 202 being fully latched or in some cases, even being closed. Furthermore, reed switch 502 is also mounted at the latch in the front, at the working area of the thief hatch, thereby also being suitable to being jolted and bumped during gauging and thiefing operations. Furthermore, no prior art mechanism provides any information as to the mechanical condition of the pressure seal.

What is needed is a mechanism for correctly detecting the closure state of thief hatch lid 202, one which can accurately distinguish between a thief hatch lid that is closed and latched from one that is merely closed. Additionally, a mechanism that can also be used to determine baseline parameter values for a correctly functioning thief hatch would be very advantageous. The values of those parameters could then be monitored and compared to the baseline values of the parameters to determine the condition of the thief hatch. The greater the deviation of the monitored values from the baseline parameter values, the greater the risk of VOC leakage from the thief hatch.

BRIEF SUMMARY OF THE INVENTION

The present invention is related to verifying the closure state of a hatch. A force sensor is positioned between the upper sealing ring of the hatch lid and the lower sealing ring of the flange, adjacent to the pressure gasket. In the opened position, force sensor detects little force between the upper and lower sealing rings, in the closed position, the sensors detects an increase in force, but in the closed and latched position, the force sensor detects much higher force between the upper and lower sealing rings.

The force sensor is electrically coupled to a monitor unit that delivers power to the sensor and communicates the force readings (either as raw or processed data) to a remote location such as data/processing remote centers, clouds, or portable devices. Cry-out alarms may be employed to alert operators when a hatch is open or not securely latched.

BRIEF DESCRIPTION OF THE SEVERAL VIEWS OF THE DRAWINGS

The novel features believed characteristic of the present invention are set forth in the appended claims. The invention itself, however, as well as a preferred mode of use, further objectives and advantages thereof, will be best understood by reference to the following detailed description of an illustrative embodiment when read in conjunction with the accompanying drawings wherein:

Figure 1:
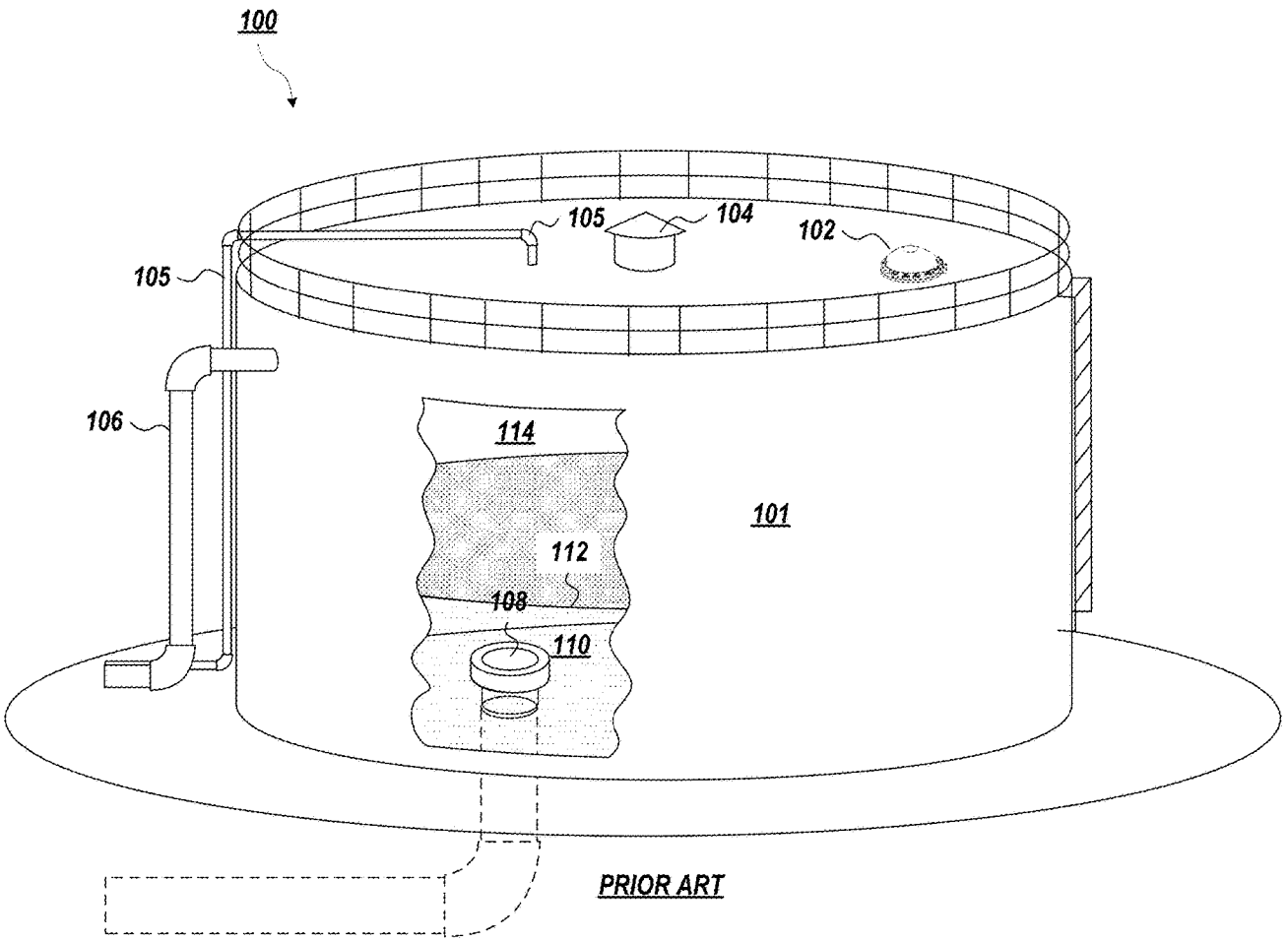
FIG. 1 is a diagram of a generic terrestrial tank as typically used in the petroleum industry.
Figure 2A:
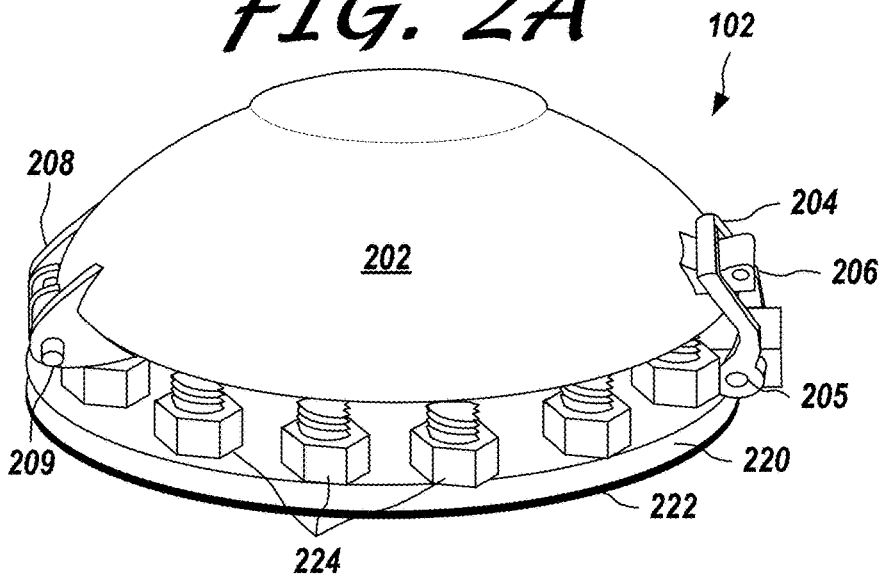
FIGS. 2A, 2B, 2C and 2D are oblique, side, top and cross-sectional views of a generic thief hatch.
Figure 2B:
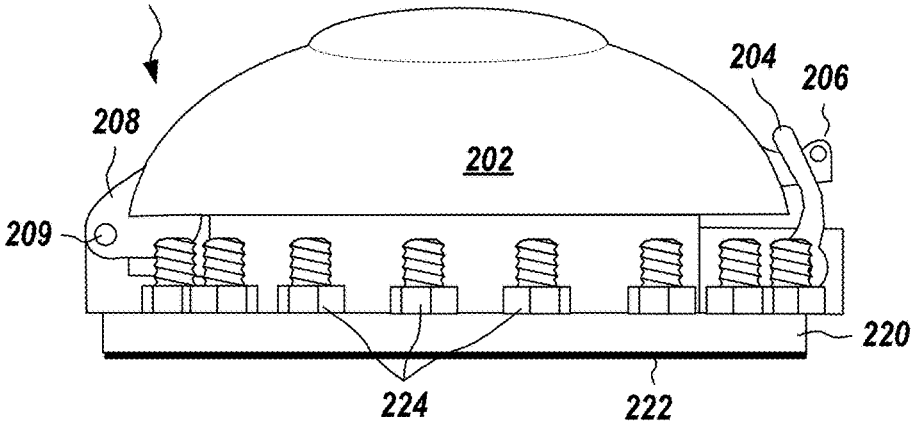
PRIOR ART FIG. 2B
Figure 2C:
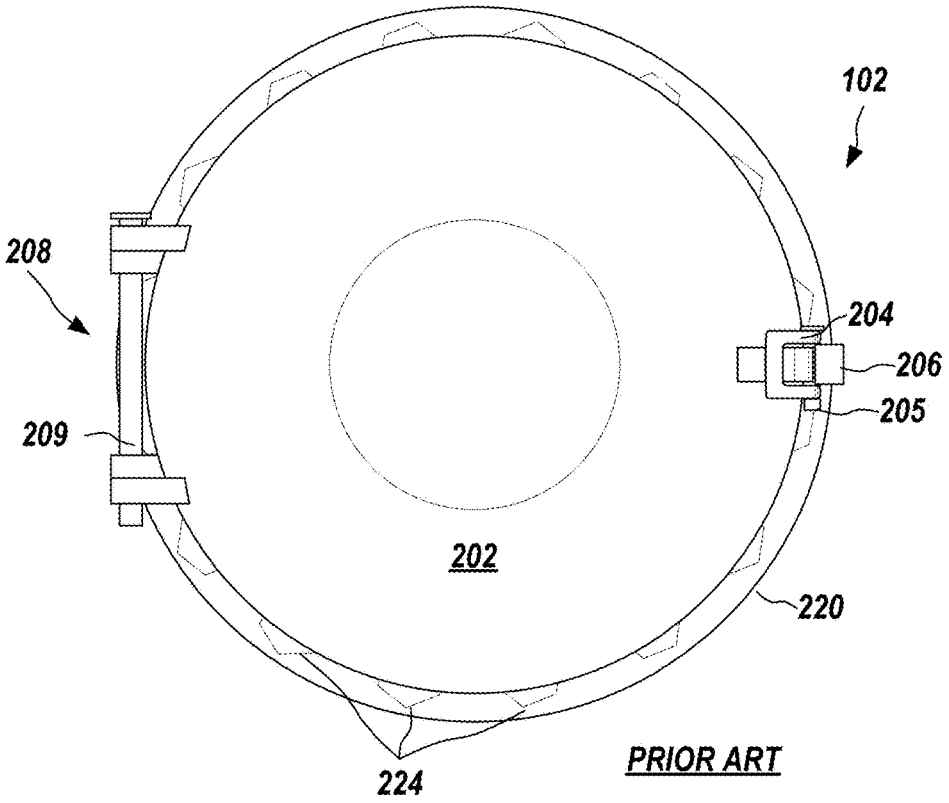
Figure 2D:
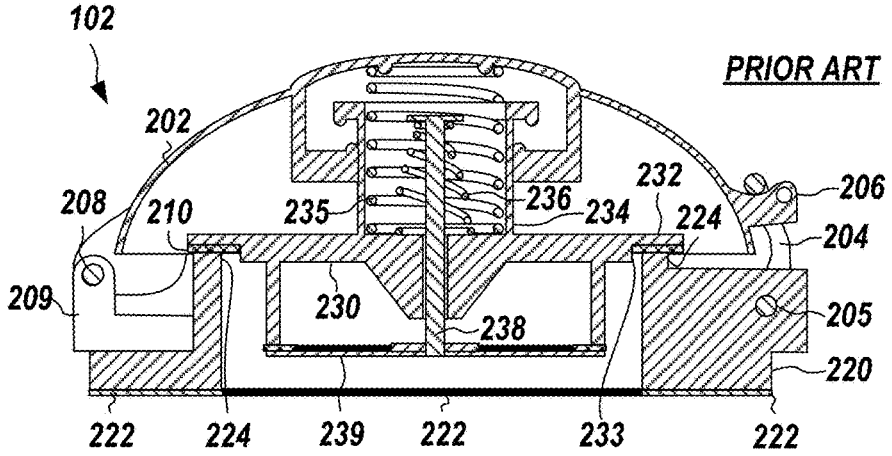
Figure 3A:
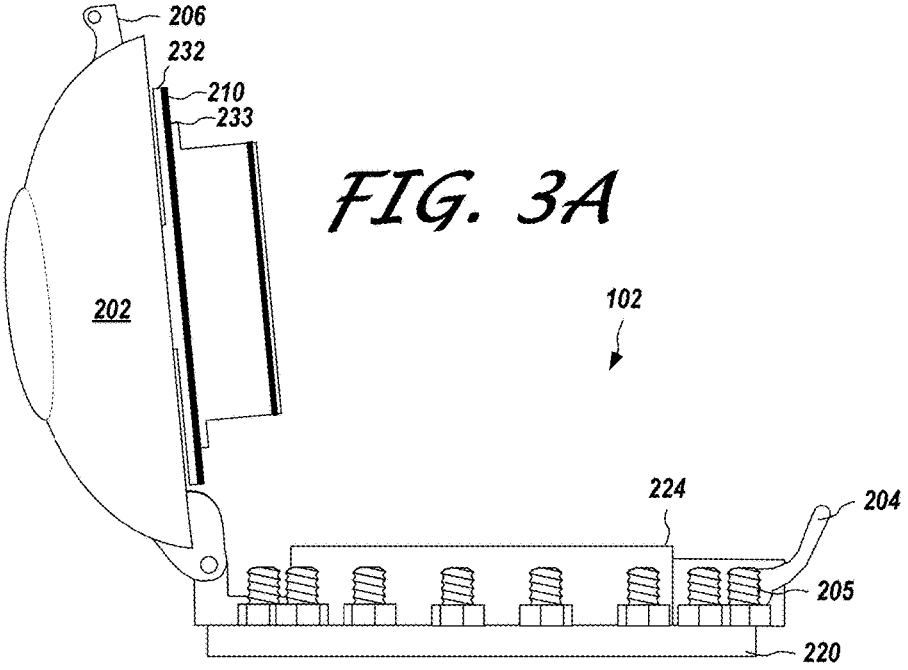
FIG. 3A PRIOR ART
FIGS. 3A, 3B, 3C, 3D and 3E are diagrams depicting the three closure states of a typical thief hatch: open in FIG. 3A; closed in FIG. 3B; closed, latched in FIG. 3C; and two intermediated closing states in FIGS. 3D and 3E.
Figure 3B:
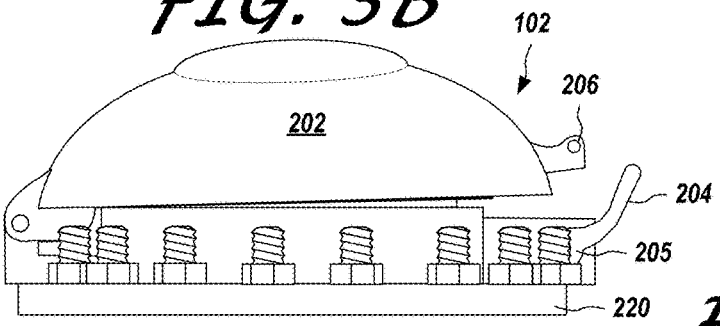
FIG. 3B PRIOR ART
Figure 3C:
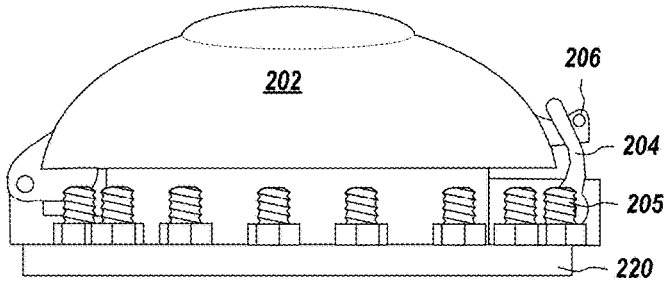
FIG. 3C PRIOR ART
Figure 3D:
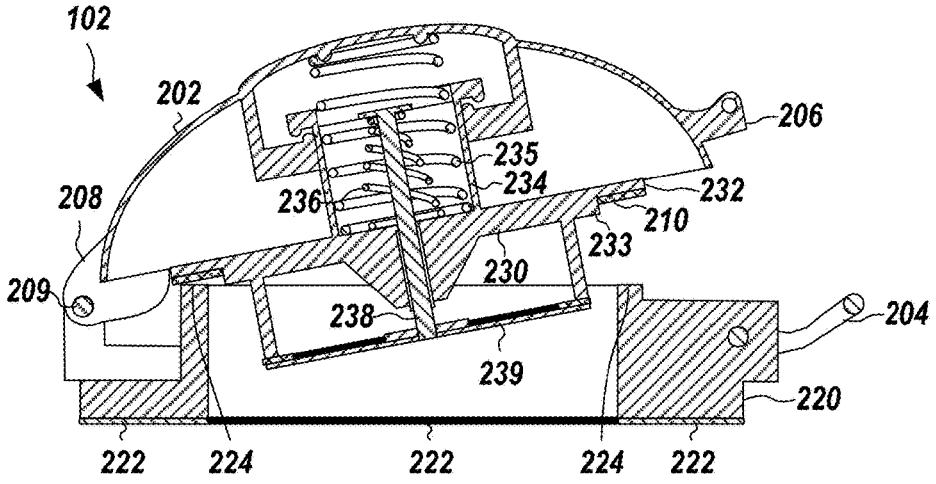
Figure 3E:
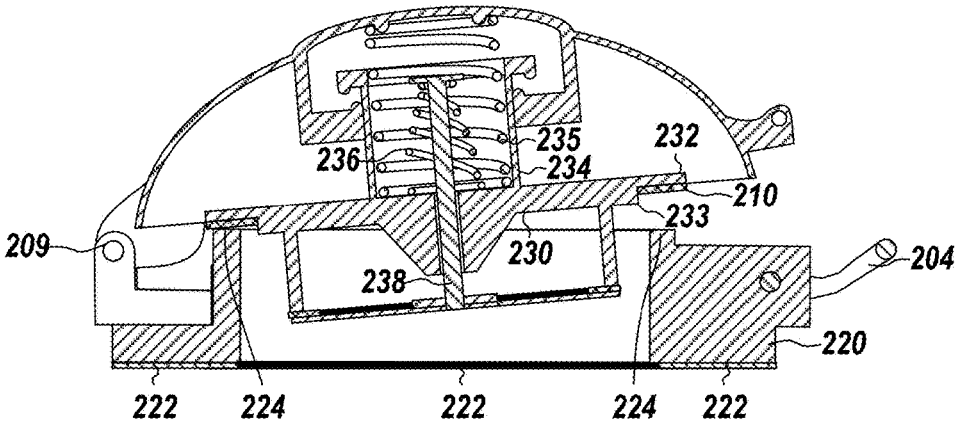
PRIOR ART FIG. 3E
Figure 4A:
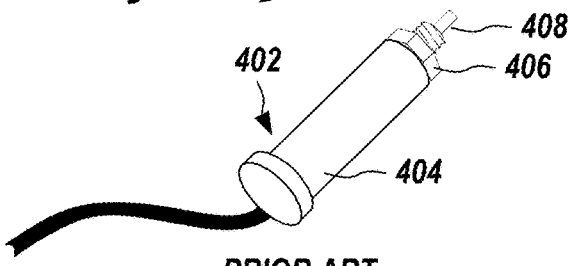
FIG. 4A is a diagram depicting a normally closed (momentary off) door plunger switch and FIGS. 4B, and 4C depict diagrams of the plunger switch implemented on a thief hatch, in the closed and latched position (FIG. 4B) and open position (FIG. 4C), as known in the prior art.
Figure 4B:
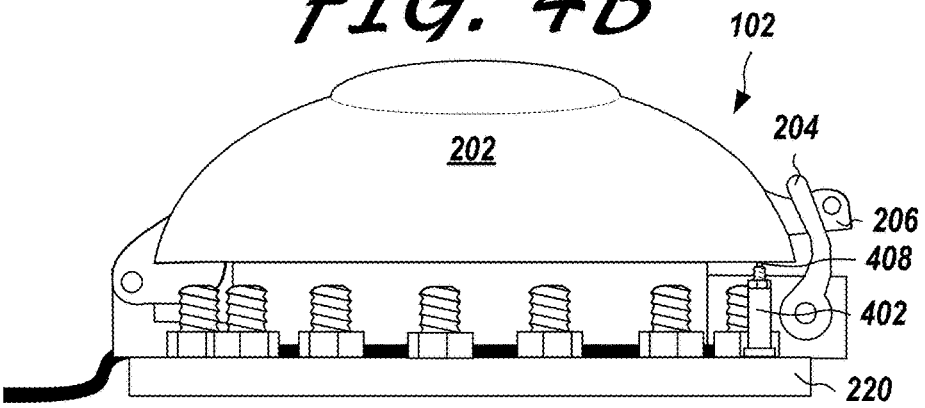
PRIOR ART FIG. 4B
Figure 4C:
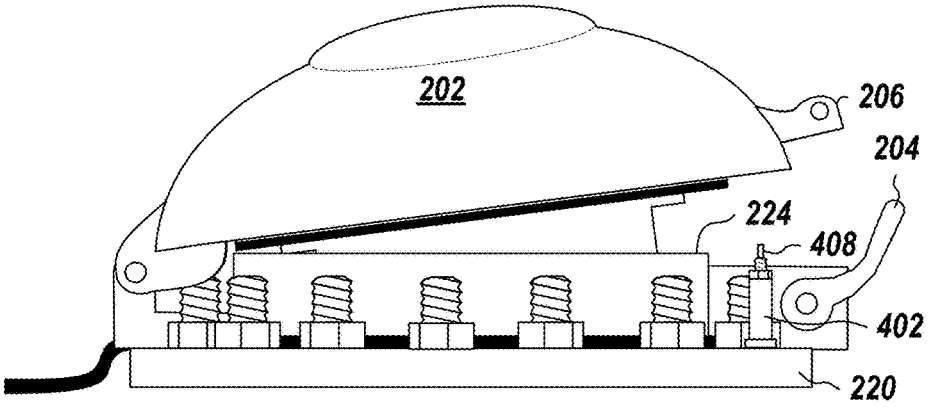
PRIOR ART FIG. 4C
Figure 5A:
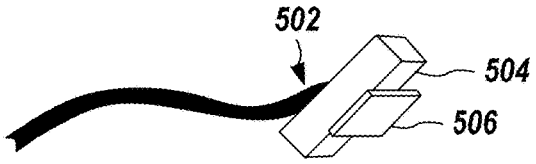
FIG. 5A is a diagram depicting a normally open magnet reed switch and FIGS. 5B, and 5C depict diagrams of the reed switch implemented on a thief hatch, in the closed and latched position (FIG. 5B) and open position (FIG. 5C), as known in the prior art.
Figure 5B:
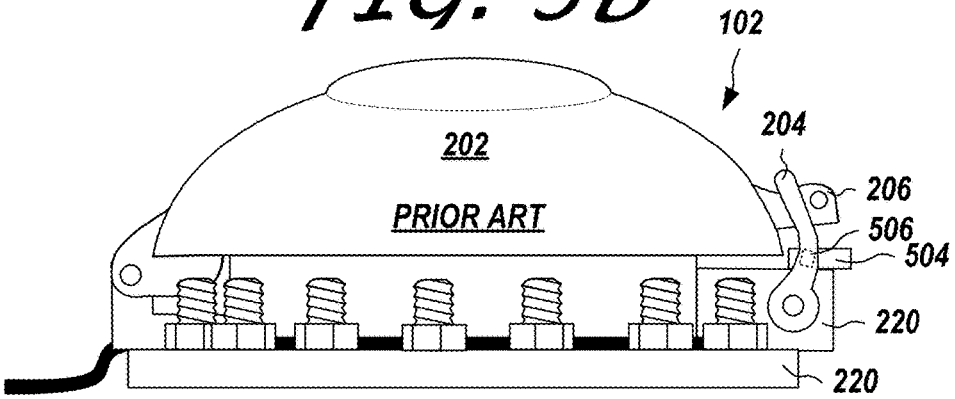
PRIOR ART FIG. 5B
Figure 5C:
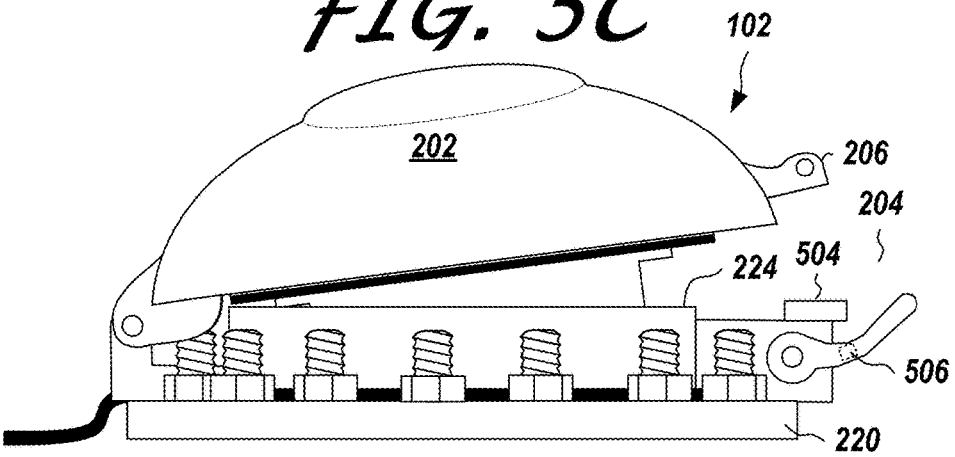
PRIOR ART FIG. 5C

Other features of the present invention will be apparent from the accompanying drawings and from the following detailed description.

DETAILED DESCRIPTION OF THE INVENTION

| Element Reference Number Designations |
|---|
| 100: Generic Storage Tank |
| 102: Thief Hatch |
| 104: VOC Vent |
| 105: VOC Recovery System |
| 106: Inlet Pipe |

-continued

| Element Reference Number Designations |
|---|
| 108: Outlet Pipe |
| 110: Fluid |
| 112: Fluid Surface |
| 114: VOCs |
| 202: Lid |
| 204: Latch |
| 205: Latch Pin |
| 206: Latch Catch |
| 208: Hinge |
| 209: Hinge Pin |
| 210: Pressure Gasket |
| 212: Lid Cover Opening |
| 220: Flange Base |
| 222: Flange Gasket |
| 224: Lower Sealing Ring |
| 226: Flange Studs/Bolts/Nuts |
| 230: Hatch Cover (Casting) |
| 232: Upper Sealing Ring |
| 233: Vertical Lip (Hatch Cover) |
| 234: Pressure/Vacuum Compensation Valve |
| 235: Pressure Compensation Spring |
| 236: Vacuum Compensation Spring |
| 237: Vacuum Compensation Ports |
| 238: Valve Stem |
| 239: Vacuum Plate |
| 240: Vacuum Plate Seal |
| 402: Door Plunger Switch |
| 404: Body |
| 406: Plunger Adjustment |
| 408: Plunger |
| 502: Normally Open Reed Switch |
| 504: Body |
| 506: Magnet |
| 602: Flexible Force Sensor |
| 604: Sensor Area |
| 606: Conductor |
| 608: Substrate |
| 610: Conductor Legs |
| 902: Sealing Jacket |

In the following description, reference is made to the accompanying drawings that form a part hereof, and in which is shown by way of illustration, specific embodiments in which the invention may be practiced. These embodiments are described in sufficient detail to enable those skilled in the art to practice the invention, and it is to be understood that other embodiments may be utilized. It is also to be understood that structural, procedural and system changes may be made without departing from the spirit and scope of the present invention. The following description is, therefore, not to be taken in a limiting sense. For clarity of exposition, like features shown in the accompanying drawings are indicated with like reference numerals and similar features as shown in alternate embodiments in the drawings are indicated with similar reference numerals.

The U.S. Environmental Protection Agency (EPA) has defined VOCs as any "compound of carbon, excluding carbon monoxide, carbon dioxide, carbonic acid, metallic carbides or carbonates, and ammonium carbonate, which participates in atmospheric photochemical reactions," and has identified exceptions for compounds "determined to have negligible photochemical." With regard to the storage of hydrocarbons, the EPA, as well as many state environmental agencies, have promulgated rules regarding the unchecked emission of VOCs into the atmosphere. These rules pertain to: limitations on the landing of floating roof tanks; testing, inspection and monitoring requirements of tanks; the control of flash emission from fixed roof storage tanks; and specific requirements for tank fittings, seals and hatches for eliminating the leakage of VOCs.

While these compounds are harmful to the environment, they are relatively easy for agency inspectors to detect escaping from a storage tank. Using IR (infrared) imaging, VOC emissions and other VOC leaks can be detected instantaneously from pipes, pipelines, fittings, hatches, vents, valves and other components normally associated with the transportation and storage of VOC emitting compounds. Moreover, IR imaging devices are relatively inexpensive, readily available, generally foolproof and create a digital record of a VOC emission event. Handheld IR imaging devices are in widespread use by agency regulators, environmental watch dogs and even private citizens. Recently, a citizens' groups comprised mainly of retirees in Lehigh Acres, Fla., purchased very inexpensive optical filters for their smartphones and created digital records of alleged VOC emission violations that spurred the state's environmental protection agency to more actively monitor VOCs.

Furthermore, state and federal agencies have used various techniques in deploying these IR imaging devices. Portable IR imaging devices are issued or available to most field agents for overt and covert site inspections. Larger and more sensitive IR imaging devices are deployed in aircraft and satellite IR imaging is being investigated. Fix-site IR units are currently being deployed at tank farms, pump stations, trucking, rail and marine terminals and virtually anywhere an agency perceives a need and can get a consent agreement or mandatory authorization associated with site permitting for provisioning. Site operators are increasingly employing their own IR imaging devices for monitoring and abating VOC emissions, however, this technology is not as valuable for the operators because the technology merely makes a record of VOC emissions and does little in the way of proactive abatement, and also because the operators' own IR digital record can often be used as evidence against them. The problem is not merely academic, some states, such as Colorado, have promulgated fines of up to $17,000.00 per day, per VOC emission violation event.

While VOC emission and leaks may occur at many points along the production and transmission circuit, emission from hatch covers are particularly problematic. This is so because thief hatch leaks tend to emit a large volume of VOCs in a short period of time, they rarely result from a component failure such as a cracked pipe or seal and, most importantly, because they are virtually all the result of human error and, therefore, nearly 100% preventable. What is needed is a reliable in situ mechanism for accurately detecting the closure state of a thief hatch (open, closed or closed and latched), suitable for virtually any thief hatch design (as well as other generic hatch designs), uncomplicated to install, inexpensive to procure and operate and that automatically monitors hatch closure events in the background with minimal human intervention.

In accordance with an exemplary embodiment of the presently described invention, a device and system are disclosed for automatically monitoring the closure state of a thief hatch (open, closed or closed and latched), in real time, as well as monitoring inferences to the condition of the thief hatch and associated pressure valve. The presently described device/system is suitable for use with virtually any thief hatch design (as well as other generic hatch designs), it is uncomplicated, easy to install, inexpensive to procure and operate, and automatically monitors hatch closure events with minimal human intervention. In sharp contrast with prior art hatch lid position sensors, the presently described invention monitors the force applied to the thief hatch lid 202, through hatch cover casting 230, and on to lower sealing ring 224 of the base flange 220 across the pressure gasket 210, without compromising the sealing capabilities of the pressure gasket 210.

Figure 6A:
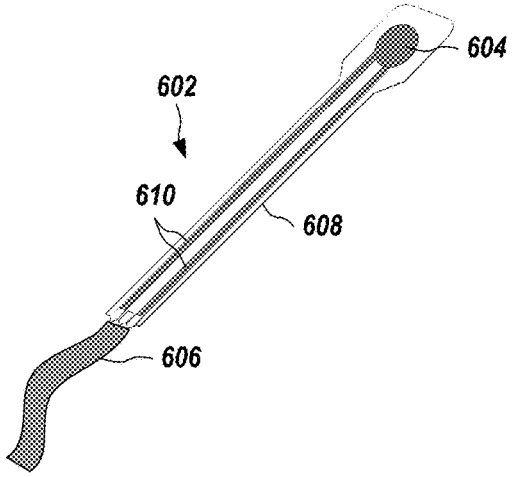
FIG. 6A is a diagram depicting an exemplary flexible force sensor in accordance with one exemplary embodiment of the present invention.

In accordance with one exemplary embodiment of the present invention, this is accomplished through the use of a force sensor, specifically a flexible force sensor for measuring the force between hatch cover casting 230 and lower sealing ring 224 of base flange 222. FIG. 6A is a diagram of an exemplary flexible force sensor in accordance with one embodiment of the present invention. Flexible force sensor 602, such as those available from Tekscan, Incorporated of South Boston, Mass., are exceptionally thin, often less than 0.2 mm and generally comprised of a pair of pressure sensitive ink layers, usually circular shaped, with a coextensive conductor layer on either side of the ink. Exemplary flexible force sensor 602 is depicted with a circular sensor area 604, which is the most common shape, and least expensive. However, other shaped sensor areas are readily available, such as square, rectangular, ring-shaped, etc., and vendors offer custom shape and configuration options.

A conductor leg 610 from each terminates at conductor 606. In practice, each coextensive conductor layer and conductor leg 610 are formed from a single sheet of conductor and separated from each other with an adhesive insulator, but connected to either side of the pressure sensitive ink with an adhesive dielectric. The entire device is packaged in a flexible substrate 608 except for the terminal ends for connecting to conductor 606. It should be stressed that this sensor embodiment is merely exemplary and other suitable sensors exist, such as wire mesh sensors, force sensitive resistors, semiconductor strain gauges, piezoceramic sensors and others. It should also be mentioned that these types sensor offer a quantified measurement rather than a qualified, hence, in most cases individual flexible force sensor 602 will need on-site calibrating.

Figure 6B:
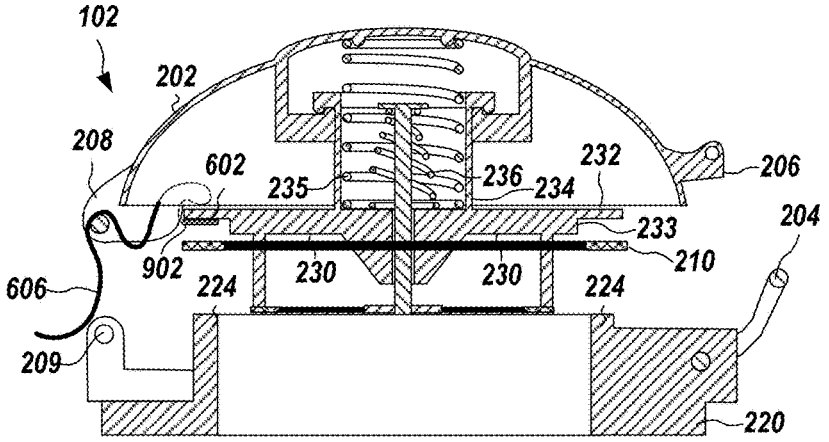
FIGS. 6B-6E are diagrams depicting a thief hatch in various closure states with an exemplary flexible force sensor in accordance with one exemplary embodiment of the present invention.
Figure 6C:
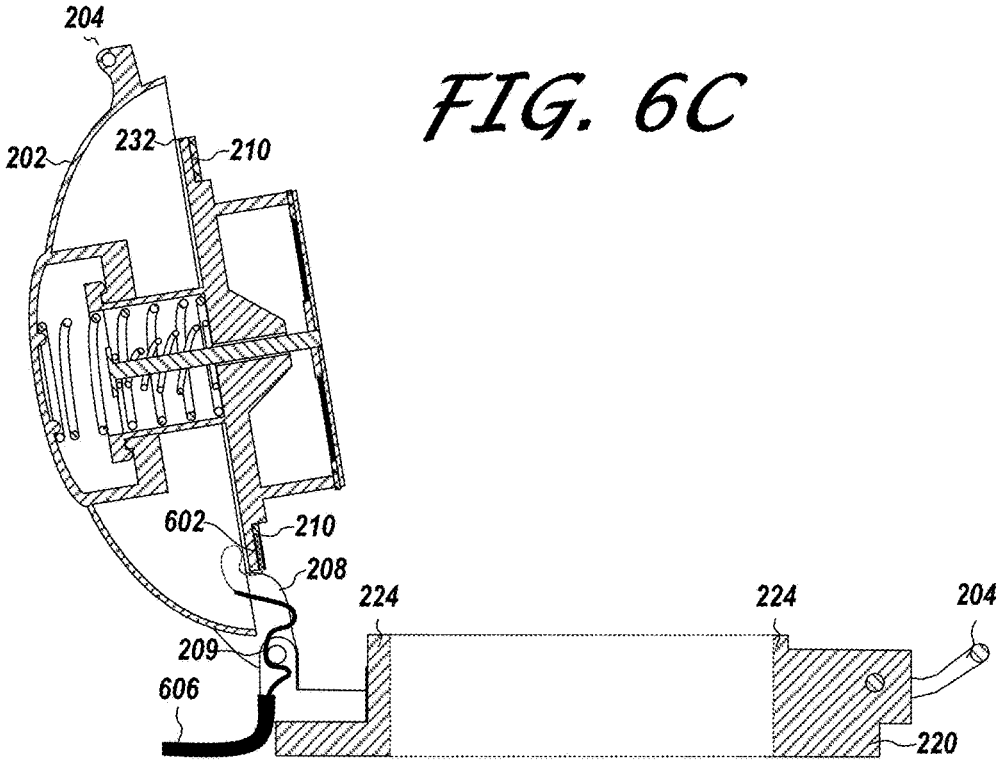
Figure 6D:
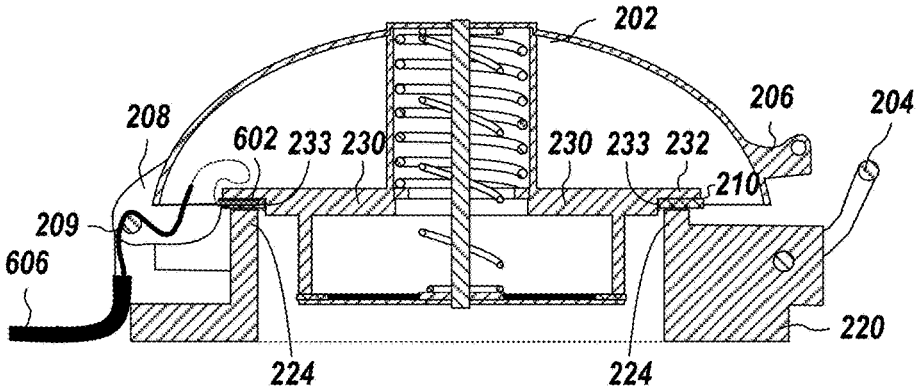

In any case, the aim is to position sensor area 604 of flexible force sensor 602 directly between upper sealing ring 232 of hatch cover casting 230 and lower sealing ring 224 of the base flange 220, in direct alignment with pressure gasket 210 as can be appreciated from the diagrams in FIG. 6B as well as from FIG. 6C and FIG. 6D. In so doing, the force exerted across pressure gasket 210 can be accurately sensed as can be readily understood from the pressure diagram depicted in FIG. 7A (discussed further below). More particularly, flexible force sensor 602 is disposed proximate to hatch cover 230 and optimally, mounted near the hinge 208 side of hatch lid 202. In so doing, it is far less likely that flexible force sensor 602 will be damaged by operation in the thief hatch as it will be mounted directly opposite of the working area of the thief hatch.

Figure 9A:
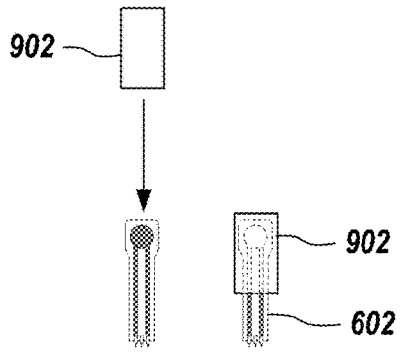
FIGS. 9A-9B are diagrams depicting a flexible force sensor configured with a sealing jacket and options of containment within a pressure gasket in accordance with various exemplary embodiments of the present invention.

Flexible force sensor 602 can be mounted on lid 202 using any one of several techniques, each designed to protect the sensor from damage and premature wear. In accordance with one technique, flexible force sensor 602 is mounted directly above pressure gasket 210 and between pressure gasket 210 and upper sealing ring 232 of hatch cover casting 230. Substrate 608 and flexible legs 610 can be pushed up and above lid 202 thereby allowing conductor 606 to be fed over hinge pin 209 and further protected from accidental damage. This technique may result is a very slight leak between substrate 608 and lid 202 if substrate 608 creates a path across lid gasket 210. Therefore, flexible force sensor 602, at least to sensor area 604, may be covered by sealing jacket 902 as depicted in FIG. 9A. Sealing jacket 902 is comprised of a thin layer of gasket material identical to that described above with regard to pressure gasket 210. Optionally, flexible force sensor 602 may be manufactured with sealing jacket 902 or sealing jacket 902 may be manufactured independently for receiving flexible force sensor 602 immediately prior to being installed on a hatch cover. Alternatively, pressure gasket 210 may be manufactured with one or more slits extending from the outer edge for receiving flexible force sensor 602 (not shown). The slit(s) should be wide enough to easily accommodate flexible force sensor 602. Optimally, the slit should not extend through pressure gasket 210 to the inner edge, thereby eliminating any opportunity of pressure to communicate between the inner and outer edges of pressure gasket 210 through the slit.

In accordance with still another exemplary embodiment of the present invention, gasket material may be extruded around the sensor area(s) of one or more flexible force sensors **602-1-602-*n*, thereby enclosing flexible force sensors 602-1-602-*n* within pressure gasket 210. This embodiment is graphically depicted in FIG. 9**B.

Figure 7E:
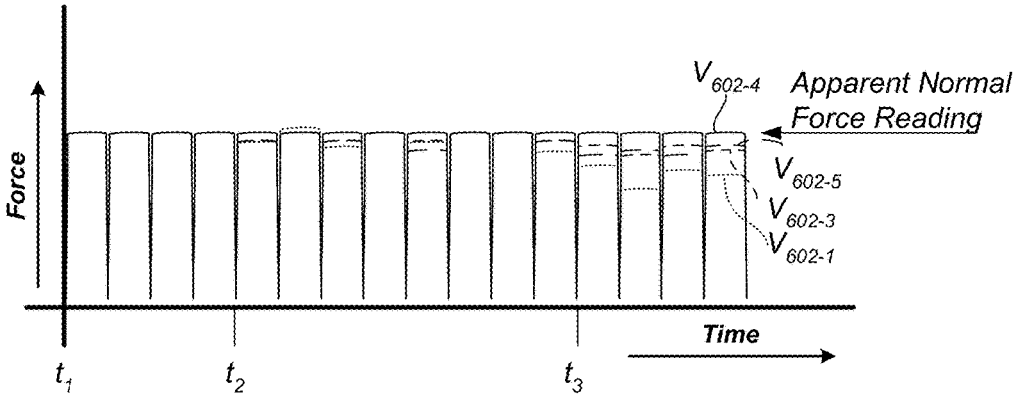
FIG. 7E is a diagram of a force chart depicting the forces exerted between the upper and lower sealing rings of a thief hatch at various positions and at various closure states over a time period.

In accordance with one exemplary embodiment of the present invention, pressure gasket 210 is formed around a single flexible force sensor 602-1, or alternatively, around a primary sensor and a backup sensor in case of sensor failure (flexible force sensors 602-1 and 602-2). In accordance with other exemplary embodiments of the present invention, pressure gasket 210 is formed around a multiple flexible force sensors that are fixed at predetermined positions about pressure gasket 210, for example four sensors spaced at ninety degree intervals, flexible force sensors 602-1, 602-3, 602-4 and 605-5 or three sensors spaced at one-hundred and twenty degree intervals, flexible force sensors 602-1, 602-6 and 605-7. The benefit of using multiple sensors will be discussed further below with regard to FIG. 7E.

Figure 6E:
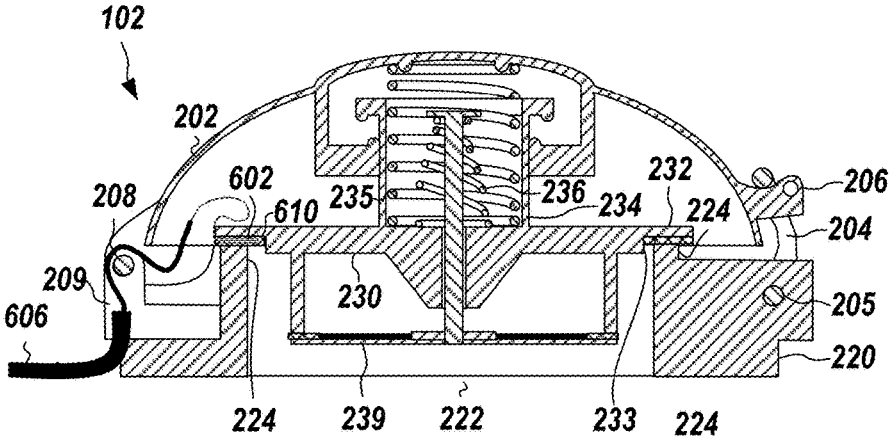
Figure 7A:
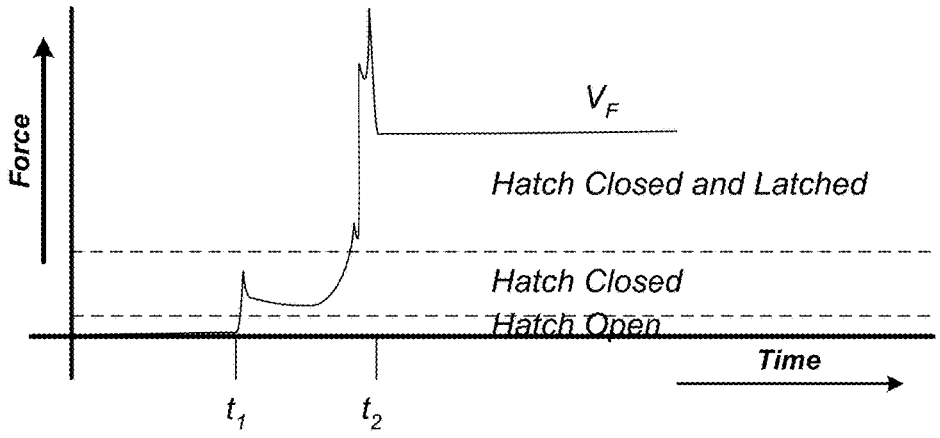
FIG. 7A is a diagram of a force chart depicting the force exerted between the upper and lower sealing rings of a thief hatch.

Returning to the discussion of FIGS. 6-6D, with regard to pressure chart depicted in FIG. 7A, one advantage of the present invention is that the placement of flexible force sensor 602 enables operators to readily distinguish between the three closure states of a thief hatch, i.e., open, closed and closed and latched. For example, in FIG. 6C lid 202 is depicted as being in the open state, wherein pressure gasket 210 is not in contact with lower sealing ring 224 of flange base 220, as may be necessary for performing gauging or thiefing operations in a thief hatch. As no force is exerted on flexible force sensor 602, the corresponding force measurement by flexible force sensor 602 reflects the absences of force, as shown in the force diagram in FIG. 7A, prior to time $t_1$.

Subsequent to the operation, say at time $t_1$, the hatch is first closed, but not latched as shown in FIG. 6D with lid 202 down and the weight of lid 202 and hatch cover casting 230 generating a force across pressure gasket 210. During this time period, the force sensed by flexible force sensor 602 is greater than the force detected with the hatch open, but, as will be discussed later, much less than the force detected with lid 202 being latched. The force diagram in FIG. 7A depicts the force detected by flexible force sensor 602 with lid 202 closed but not latched between times $t_1$ and $t_2$.

Finally, the act of latching most contemporary thief hatches, depicted graphically in FIG. 6E, creates a latching force across pressure gasket 210 that is greater than the force generated by the hatch being merely closed. As discussed above with regard to FIGS. 2 and 3, the sealing force of thief hatch 102 is actually created by pressure compensation spring 235 exerting force between lid 202 and hatch cover casting 230. As lid 202 is closed, pressure compensation spring 235 is compressed and forces hatch cover casting 230 toward base flange 220. In so doing, the entire circumference of upper sealing ring 232 of hatch cover casting 230 is forced down on to the entire circumference of lower sealing ring 224 of flange base 220, across pressure gasket 210. The latching force eliminates any possibility of leakage by deforming the shape of pressure gasket 210 to the surfaces of upper sealing ring 232 on hatch cover casting 230 and upper sealing ring 224 of flange base 220. The difference between the closing force exerted on flexible force sensor 602 and the latching force can be see clearly on the force diagram depicted in FIG. 7A, subsequent to time $t_2$.

Figure 7B:
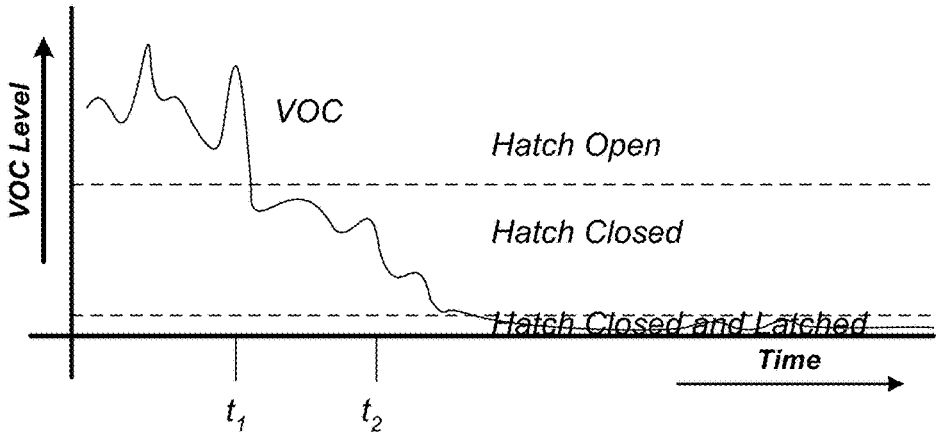
FIG. 7B is a diagram of a VOC emissions chart depicting the VOC levels escaping a thief hatch in various closure states.

The importance of verifying that a thief hatch is securely closed and latched cannot be overstated. With regard to VOCs escaping into the atmosphere, a closed but not latched hatch cover is more similar to an open hatch cover than to a latched hatch cover. Current hatch covers and hatch lids are usually fabricated from lightweight materials such as aluminum, and designed to minimize the amount of material needed. Hence, these hatch covers and hatch lids are extremely light and, therefore, will not provide a sufficient seal to completely block escaping VOCs. FIG. 7B is a diagram of VOC emission corresponding to the time period of FIG. 7A. Notice that, as expected, the level of escaping VOCs is very high while hatch cover 202 is open, prior to time $t_1$, and extremely low when hatch cover 202 is closed and latched subsequent to time $t_2$. However, in the time between time $t_1$ and time $t_2$, the level of escaping VOC remains rather high, very close to the VOC emission level with the hatch open. Therefore, forgetting to or improperly latching a thief hatch may have the same detrimental consequences as leaving the hatch open.

Another advantage of the presently described invention that may not be readily apparent is the ability to monitor the condition of the sealing force and accurately predict gasket and other failures that result in the escape of VOCs. By using a data logger (as will be described later with regard to FIGS. 8A and 8B), the force generated by latching may be recorded and monitored for changes indicating a potential failure that would result in VOCs escaping.

Figure 7C:
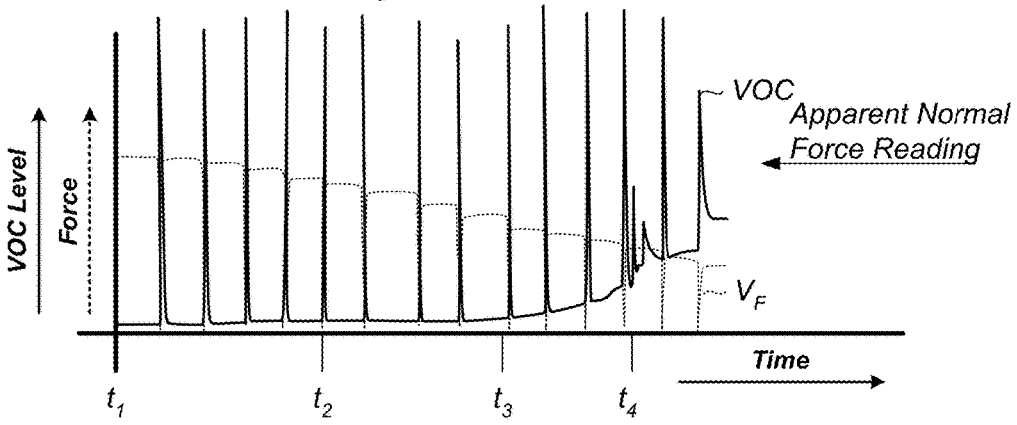
FIGS. 7C and 7D are diagrams of a combination force and VOC emissions chart depicting the force exerted between the upper and lower sealing rings of a thief hatch and the corresponding levels of VOC escaping a thief hatch in various closure states over a time period.

There are two cases in particular, the first depicted on the VOC/force chart depicted in FIG. 7C relates to a decrease in latching force. During a time period, say between time $t_1$ and time $t_2$, where pressure gasket 210 is new, the latch force ($V_F$ correlating to the voltage generated by the flexible force sensor) remains fairly constant at an apparent normal force reading wherein the hatch is repeatedly open for gauging/thiefing operations (shown as a low voltage spike on $V_F$ and a corresponding high VOC level spike on VOC in FIG. 7C). However, at some point the gasket begins to lose its flexibility, crack, tear or otherwise deteriorate. This degradation results in the latching force decreasing as realized from the flexible force sensor opening between times $t_2$ and $t_3$. Between times $t_3$ and $t_4$ escaping VOCs can be noticed from the increasing VOC level. At some point, time $t_4$ in FIG. 7C, the pressure gasket fails and the VOC level increases substantially. Here, the advantage of using the present invention is that patterns of gasket degradation can be recognized and tracked from the data log created for latching force, and when the force drops below a threshold level, the pressure gasket is replaced or other maintenance performed as necessary.

Figure 7D:
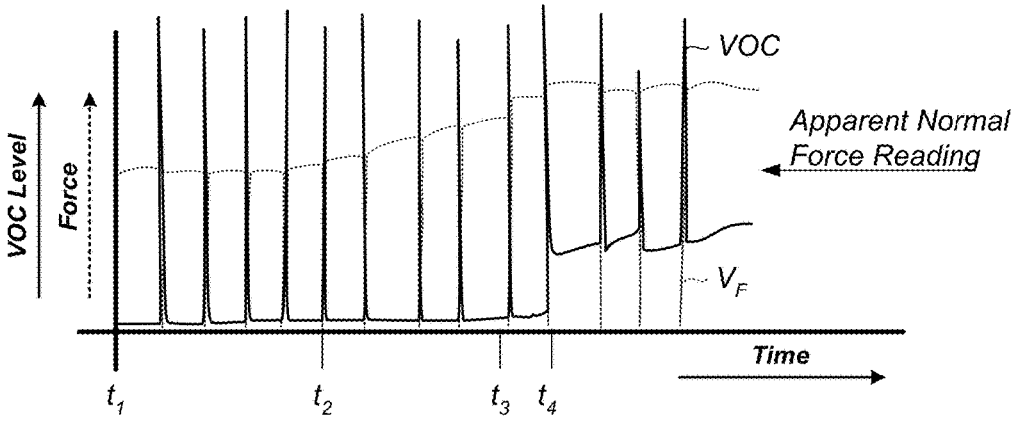

The second case relates to an increase in latching force as depicted on the VOC/force chart depicted in FIG. 7D. Here, during a time period between time $t_1$ and time $t_2$, where pressure gasket 210 is new and the sealing surfaces are clean and free of contaminants, the latch force remains fairly constant at an apparent normal force reading just as in FIG. 7C above. However, over time, between times $t_2$ and $t_3$, dirt, debris, dried oil and other contaminants build up as a film of contaminants on each of the adjacent surfaces of pressure gasket 210 and lower sealing ring 224 of base flange 220 (from spillage and mess from repeated gauging and thiefing operations). This decreases the gap between pressure gasket 210 and lower sealing ring 224 and resulting in a slightly higher force when the cover is latched. This film of contaminants does not provide the same sealing properties as clean surfaces and will eventually leak, time $t_4$ in FIG. 7D. Here again, the key to using the force data log is to recognize patterns developing and take appropriate action prior to a serious VOC leak event.

Figure 9B:
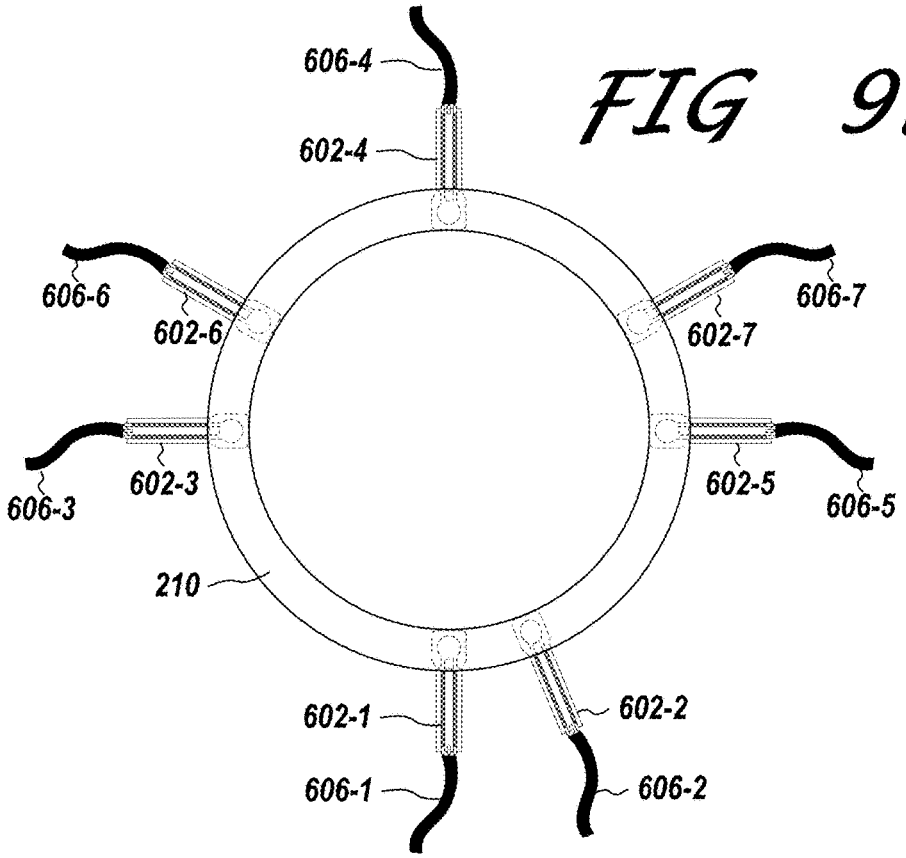

Of course, sensor reliability is critical, therefore, having a backup flexible sensor in place is advantageous, such as flexible sensors 602-1 and 602-2 as depicted FIG. 9B. In so doing, any of the reading in FIGS. 7A-7C would be essentially duplicated by a pair of force reading. If the pair of reading ever diverged, that would indicated a sensor failure or at least a problem needing investigation.

In addition, recalling the discussion of the closure forces that act on pressure/vacuum valve 234, there may be circumstances where the force exerted around the circumference of pressure gasket 210 may not be constant. And/or, one area of pressure gasket 210 may be more prone to failure than another area. Hence, placing multiple sensors around the circumference of pressure gasket 210 may increase the likelihood of detecting the onset of problem over using a single sensor, such as using four sensors positioned at ninety degree intervals, for example flexible force sensors 602-1, 602-3, 602-4 and 605-5 depicted in FIG. 9B. Turning to the force chart shown in FIG. 7E, notice that at the time period between time $t_1$ and $t_2$, the reading of flexible force sensors 602-1, 602-3, 602-4 and 605-5, i.e., $V_{602\text{-}1}$, $V_{602\text{-}3}$, $V_{602\text{-}4}$ and $V_{605\text{-}5}$, all track on a normal force level. However, some divergence between the readings from the apparent normal level is noticeable between times $t_2$ and $t_3$, especially with regard to flexible force sensor 602-1, reading $V_{602\text{-}1}$ and the other sensors. Subsequent to time $t_3$, the divergence of flexible force sensor 602-1, reading $V_{602\text{-}1}$ from the apparent normal force level is readily noticeable (as is some divergence between flexible force sensors 602-3 and 602-5, readings $V\mathbf{602}_{\text{-}3}$ and $V_{605\text{-}5}$ from the apparent normal force level). Clearly, the multiple force readings depicted on the diagram in FIG. 7E would indicate that an issue involving pressure gasket 210 has developed after time $t_3$.

In accordance with various exemplary embodiments of the present invention, the system for monitoring the state of hatch cover closure comprises several components: the force sensor, a monitor/detector for monitoring or detecting a reading from the force sensor, a power supply and an optional cry-out alarm (not shown). The monitor may be as uncomplicated as a normally-open circuit (such as a switching transistor) that closes and completes an electrical circuit in response the force sensor's reading dropping below an alarm threshold level (also not shown). In response, the cry-out alarm is activated. In a very uncomplicated exemplary embodiment (not shown in the figures), a power supply (battery) is electrically coupled to a switching transistor (normally open switch) through a force sensor, a cry-out alarm (visual or audio) and through the switching transistor. All the components except the sensors itself may be enclosed in a safety case and mounted on the thief hatch, if the cry-out alarm is visual, mounted in open sight. The force sensor is then mounted between the upper and lower sealing rings.

Figure 8A:
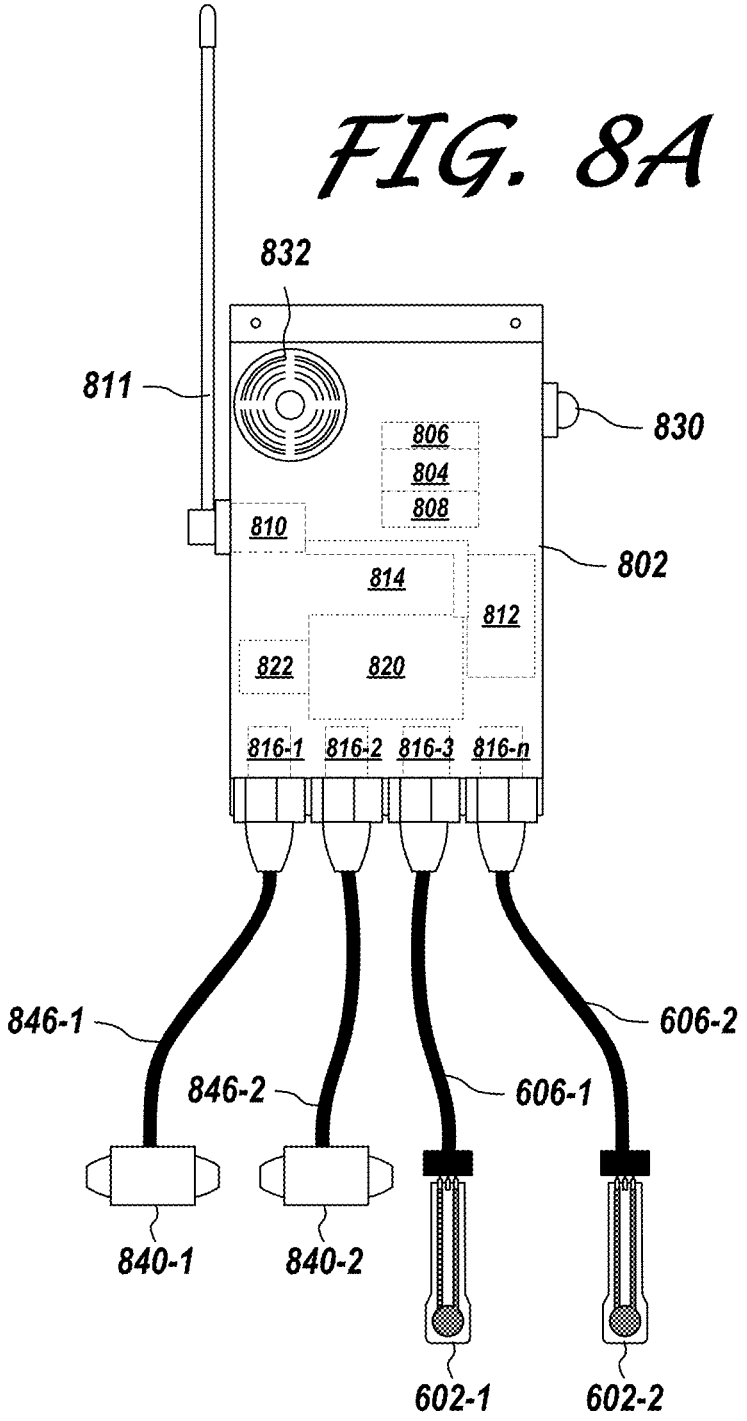
FIGS. 8A-8B are diagrams depicting a monitor unit, sensors and thief hatch in various configurations in accordance with one exemplary embodiment of the present invention.
Figure 8B:
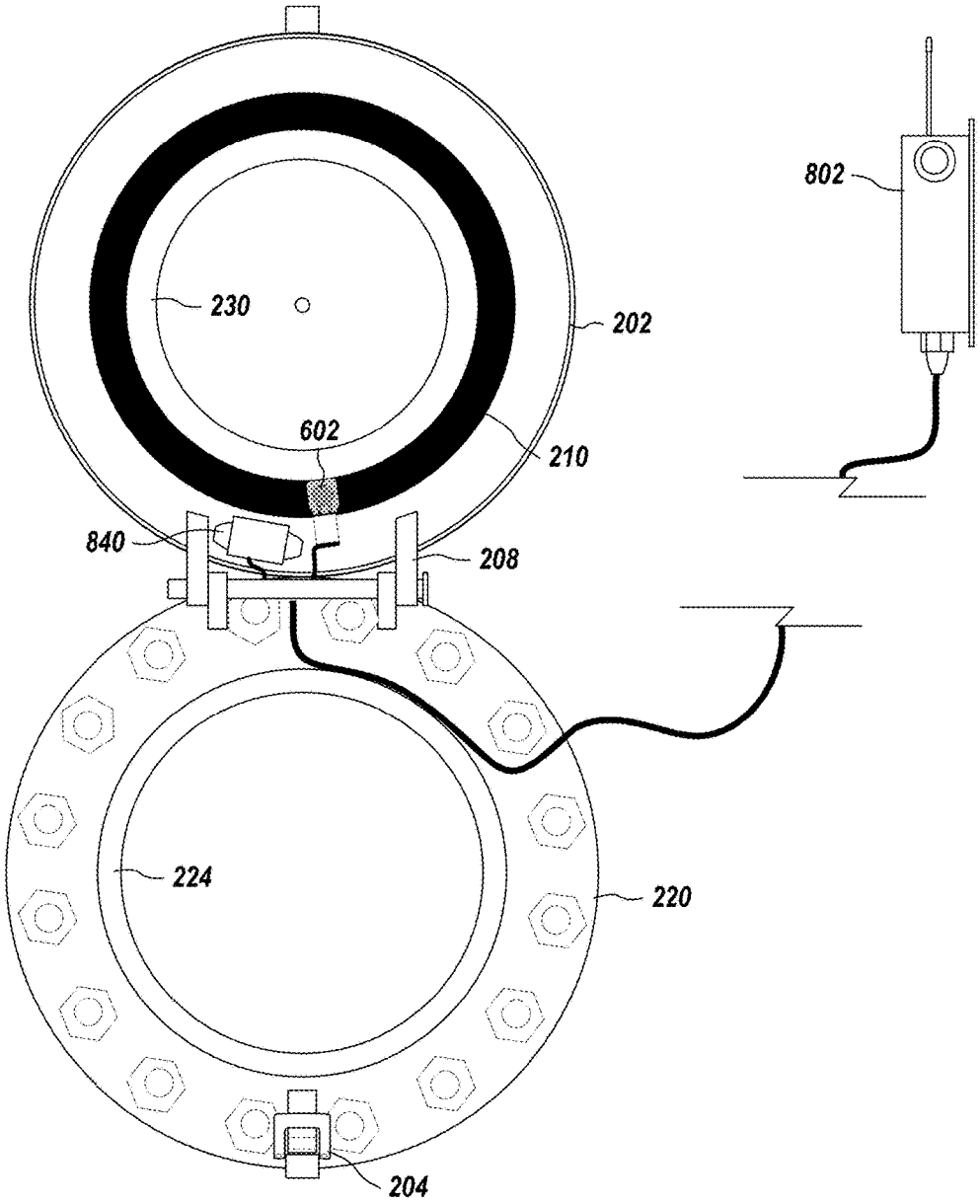

In practice, a more sophisticated approach is usually warranted, which is generally depicted in FIG. 8B. Force sensor 602 is electrically coupled to a monitoring unit for reading and processing voltages into force measurements.

One monitoring unit is the Advantis Monitoring System (AMS) (available from Advantis, L.L.C. in Marshall, Tex.). Monitoring unit 802 depicted in FIG. 8A is one exemplary embodiment of the present invention. At a very low level, monitoring unit 802 comprises at least one sensor port/interface 816-1 thru **816-*n* for supplying power to sensors, such as force sensor 602 and for receiving measurement signal data from the sensor and a communications means for communicating the data to a remote location such as a data or processing center. Sensor port/interface 816-1 thru 816-*n* may be coupled to multiple sensors on a single thief hatch, single sensors on multiple thief hatches, or some combination of the two. Optimally, sensor port/interface 816-1 is coupled to communications means 810 via data bus 814. Communications means 810 may support any or all of satellite, cellular, radio, microwave, laser and other wireless communications using an appropriate antenna 811. Additionally, communications means 810 may also support landline PSTN, Ethernet, fiber-optic, coaxial and other wired communication means at communication port 812. Monitoring unit 802 may receive power from battery 820, which may be internal or external, (solar and wind turbines are optional) and/or AC power via power adapter 822. Optionally, monitoring unit 802 may also provide basic or very sophisticated local processing using processor 806, ROM/RAM 804 and I/O 808. Monitoring unit 802 may further comprise one or more local priority cry-out alarms such as warning light 830 and audible alarm 832**.

Furthermore, although the previous discussion of force sensors focuses on analog type devices, other sensors are readily available, such as digital sensors. Hence, monitoring unit 802 may receive either analog or digital measurement signal data from the sensors. That signal data may be a raw digital or raw analog signal and transmitted directly as raw signal data. Alternatively, the raw data may be processed by a routine executing on by processor 806 or into another form or protocol depending on the measurement/alarm routine being executed on processor 806, which was stored in ROM/RAM 804. I/O 808 generally converts the signal data from one form or other depending on the component receiving the data from I/O 808.

Basically, monitoring unit 802 delivers power to sensors and receives voltage or other sensor signals and in response communicates that data to data/processing remote centers, clouds, or portable devices. Ideally, information gathered from monitoring unit 802, whether remote, local, or mobile sources, makes its way to a web application in the cloud, such as the Advantis Web Application also available from Advantis, L.L.C., which can be viewed by computer and smart phone. These devices may then process the data locally and/or compare the data to alarm thresholds and the like.

In accordance with other exemplary embodiments of the present invention, monitoring unit 802 may support a variety of different priority cry-out alarms. The purpose of a cry-out alarm is to alert someone that an alarm threshold has been crossed and a warning condition exists. Whenever a warning condition is detected (such as a thief hatch being/remaining unlatched), monitoring unit 802 activates a cry-out alarm, for example local alarms as discussed above. Also, monitoring unit 802 may utilize electronic (digital) cry-out means in the event of a warning condition, such as sending email message, text message, pager message, voice message, web app message, mobile app message, dashboard message or other type of electronic messages to designated recipients at a predetermined electronic addresses. Additionally, monitoring unit 802 may implement a priority of cry-out messages that escalates to higher level electronic addresses as the warning persists without resolution. In either case, monitoring unit 802 typically determines whether an alarm threshold has been exceeded, rather than the threshold determination being made at a remote site.

As discussed above, monitoring unit 802 may support multiple sensors, from separate hatches, multiple sensors at a single hatch or some combination of the two. One advantage of the presently described monitoring system is its ability to support a plurality of different sensor types simultaneously, for example, force sensor 602 and VOC detector 840-1 thru **840-*n*. Additionally, monitoring unit 802** may also support digital and/or analog sensors, and may also implement complicated risk management routines to determine the closure and/or physical/maintenance states of a thief hatch for transmission to a network, processing and/or data warehousing sites, a cloud and/or predetermined remote locations.

In accordance with an exemplary embodiment, monitoring unit 802 may be situated at a central location at a site for supporting several thief hatch sensors. Depending on the extent of the facility, multiple monitoring units 802 may be installed. In this configuration, the sensors are mounted to the thief hatches and sensor conductors run from the hatches to the monitoring units. If visual and/or audio cry-out alarms are present, they should be positioned such that the alarm is easily visible (and/or audible). For small facilities (or application involving only a single hatch), monitoring unit 802 may be located near a thief hatch, proximate to the force sensor. There, the cry-out alarm should be positioned such that operators working at the hatch can easily detect any alarm.

As depicted in FIG. 8B, monitoring unit 802 may be electrically coupled to both force sensor 602 and VOC detector 840 via conductors 606 and 846 respectively. Typically, VOC sensor 840 is mounted on lower side of lid 202 and above pressure gasket 210 and lower sealing ring 224.

Figure 10A:
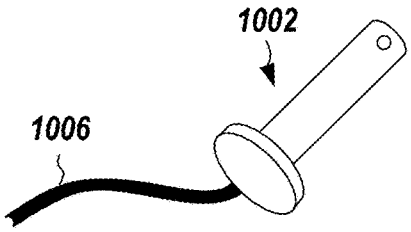
FIGS. 10A-10C are diagrams depicting a thief hatch in various closure states with an exemplary pin-type force sensor in accordance with one exemplary embodiment of the present invention.
Figure 10B:
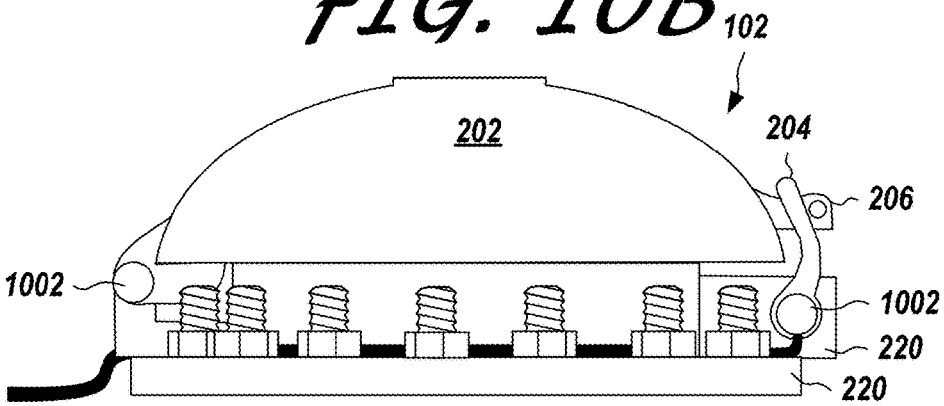
Figure 10C:
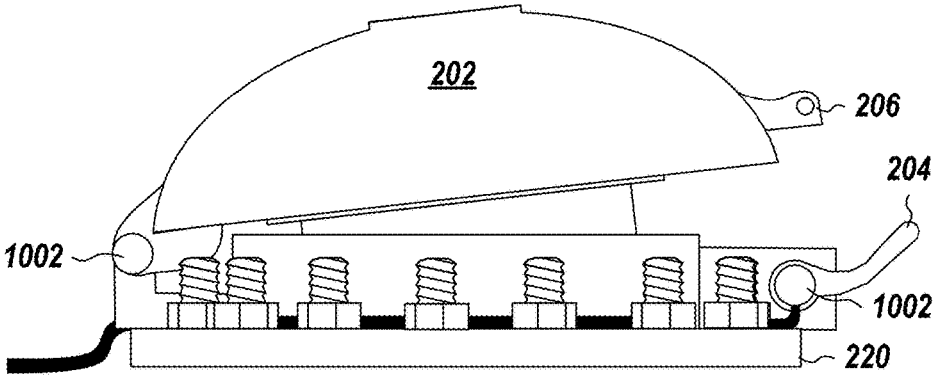

In accordance with still another exemplar of the present invention, a force sensor is incorporated in either a latch pin or hinge pin as depicted in FIGS. 10A, 10B and 10C. Here, rather than measuring the force applied to lid 202, directly at pressure gasket 210, the closing force is measured at one or more pins used to secure lid 202 to flange base 220. In the diagrams, force sensor pin 1002 replaces latch pin 205. In so doing, once lid 202 is latched, the force measured by force sensor pin 1002 will increase. Alternatively, force sensor pin 1002 may instead replace hinge pin 209. In this configuration, force sensor pin 1002 will accurately distinguish the force levels generated at the opened, closed, and closed and latched closure states of the thief hatch.

The present invention has been described in terms of a thief hatch disposed on a terrestrial storage tank for simplifying the explanation and description. However, the present invention may be implemented on virtually any hatch with a cover and seal or gasket. Moreover, the hatch may be disposed on any tank, terrestrial, truck, rail, marine or airborne. Furthermore, the hatch need only be attached to a chamber or compartment of some sort, such as a diving chamber, molding/process chamber, ships compartment, aircraft compartment, space, deep sea, etc. Moreover, the invention need not be related to the control of VOC emissions or any other environmental application.

The exemplary embodiments described below were selected and described in order to best explain the principles of the invention and the practical application, and to enable others of ordinary skill in the art to understand the invention for various embodiments with various modifications as are suited to the particular use contemplated. The particular embodiments described below are in no way intended to limit the scope of the present invention as it may be practiced in a variety of variations and environments without departing from the scope and intent of the invention. Thus, the present invention is not intended to be limited to the embodiment shown, but is to be accorded the widest scope consistent with the principles and features described herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

What is claimed is:

1. A system for monitoring hatch cover closure position of a hatch comprising a base flange with an upper sealing ring, a hatch cover lid with a lower sealing ring, a pressure gasket aligned between the upper and lower sealing rings and a hinge for coupling the hatch cover lid to the base flange and enabling the hatch cover lid to open and close, the system comprising:

a force sensor for measuring a first force and a second force between the upper sealing ring and the lower sealing ring and converting the first force and the second force to first force signal data and second force signal data, respectively, wherein the second force is indicative of the hatch cover lid in a closed state and the first force is lower than the second force and is indicative of the hatch cover lid in an open state, and the first force signal data being different from the second force signal data, the force sensor comprising:

a sensor area, said sensor area disposed at a first position between the upper sealing ring and the lower sealing ring and at one of the base flange proximate to the lower sealing ring, the hatch cover lid proximate to the upper sealing ring and the pressure gasket; and at least one conductor; and a monitor electrically coupled to the at least one conductor of the force sensor for receiving the first force signal data and the second force signal data from the force sensor.

2. The system recited in claim 1, further comprises:

a power supply electrically coupled to the at least one conductor of the force sensor.

3. The system recited in claim 1, wherein the monitor further comprises:

a cry out alarm for emitting an alert.

4. The system recited in claim 1, further comprises:

sealing material, said sealing material surrounding surfaces of the sensor area.

5. The system recited in claim 1, wherein the hatch further comprises a latch for latching the hatch cover lid to the base flange, wherein the force sensor measures a third force between the upper sealing ring and the lower sealing ring, and converts the third force to third force signal data and wherein the third force signal data being different from the second force signal data and is indicative of the hatch cover lid being latched to the base flange.

6. The system recited in claim 1, wherein the monitor further comprises:

a transmitter, wherein the transmitter is one of wired, wireless or both; and a receiver, wherein the received is one of wired, wireless or both.

7. The system recited in claim 1, wherein the sensor area further comprises:

a force sensor element, said force sensor element comprising one of force sensitive ink, wire mesh sensor, force sensitive resistor, semiconductor strain gauge and a piezoceramic sensor.

8. The system recited in claim 1, wherein the sensor area is flexible.

9. The system recited in claim 1, wherein the sensor area is disposed at the hatch cover lid and between the upper sealing ring and the pressure gasket.

10. The system recited in claim 1, wherein the sensor area is disposed at the base flange and between the lower sealing ring and the pressure gasket.

11. The system recited in claim 1, wherein the sensor area is disposed within the pressure gasket.

12. The system recited in claim 1, wherein the system further comprises:

a VOC (volatile organic compounds) sensor for measuring VOC vapors, said VOC sensor being disposed proximate to the hatch and electrically coupled to the monitor.

13. The system recited in claim 5, wherein the monitor further comprises:

a transmitter for transmitting data indicative of first force signal data, second force signal data and third force signal data to one of a remote data center, a remote processing center, a remote cloud and a remote portable system.

14. The system recited in claim 1, wherein the monitor further comprises:

a ROM (read only memory) for storing a routine for determining a closure state of a hatch cover from sensor force signal data;

a processor for executing the routine;

an I/O for receiving sensor force signal data and communicating the sensor force signal data to the processor.

15. The system recited in claim 1, further comprises:

a second force sensor for measuring a fourth force and a fifth force between the upper sealing ring and the lower sealing ring and converting the fourth force to fourth force signal data, and for converting the fifth force, which is greater than the fourth force, to fifth force signal data the fifth force being indicative of the hatch cover lid in a closed state, and the fourth force being indicative of the hatch cover lid in an open state, the second force sensor comprising:

a second sensor area, said second sensor area disposed at a second position between the upper sealing ring and the lower sealing ring and at one of the base flange proximate to the lower sealing ring, the hatch cover lid proximate to the upper sealing ring and the pressure gasket; and at least a second least one conductor.

16. The system recited in claim 5, further comprises:

a second force sensor for measuring a fourth force, a fifth force and a sixth force between the upper sealing ring and the lower sealing ring and converting the fourth force to fourth force signal data, and for converting the fifth force, which is greater than the fourth force, to fifth force signal data and for converting the sixth force, which is greater than the fifth force, to sixth force signal data, wherein the sixth force signal data being indicative of the hatch cover lid in a latched state, the fifth force being indicative of the hatch cover lid in a closed state, and the fourth force being indicative of the hatch cover lid in an open state, the second force sensor comprising:

a second sensor area, said second sensor area disposed at a second position between the upper sealing ring and the lower sealing ring and at one of the base flange proximate to the lower sealing ring, the hatch cover lid proximate to the upper sealing ring and the pressure gasket; and a second at least one conductor.

17. The system recited in claim 3, wherein the alert emitted by the cry out alarm further comprises:

a visual alert, an audio alert, an email message, a text message, a pager message, a voice message, a web page message, a web app message, a mobile app message and an electronic message.

18. The system recited in claim 1, wherein at a first time with the hatch cover lid being in the latched state, the force sensor measures a seventh force between the upper sealing ring and the lower sealing ring, and converts the seventh force to seventh force signal data, and at a second time with the hatch cover lid being in the latched state, the force sensor measures an eighth force between the upper sealing ring and the lower sealing ring, and converts the eighth force to eighth force signal data, wherein a difference between the seventh force signal data and the eighth force signal data is indication of one of a property of the pressure gasket, a property of the upper sealing ring, and a property of the lower sealing ring.

* * * * *